US005329086A

United States Patent [19]

De Matteis et al.

[11] Patent Number: 5,329,086

[45] Date of Patent: Jul. 12, 1994

[54] WAVEGUIDE FOR MICROWAVE OVENS

[75] Inventors: Michel G. De Matteis, Cambes-en-Plaine; Charles V. L. Patard, Ouistreham, both of France

[73] Assignee: Moulinex (Societe Anonyme), Bagnolet, France

[21] Appl. No.: 838,087

[22] Filed: Feb. 20, 1992

[30] Foreign Application Priority Data

Feb. 22, 1991 [FR] France ..... 91 02132

[51] Int. Cl.[5] ..... H05B 6/64

[52] U.S. Cl. ..... 219/756; 29/592.1; 219/746

[58] Field of Search ..... 219/10.55 R, 10.55 E, 219/10.55 A, 10.55 F; 29/592.1

[56] References Cited

U.S. PATENT DOCUMENTS

| | | | |
|---|---|---|---|
| 3,867,605 | 2/1975 | Yee | 219/10.55 E |
| 4,159,406 | 6/1979 | Tate et al. | 219/10.55 F |
| 4,282,416 | 8/1981 | White | 219/10.55 R |
| 4,289,945 | 9/1981 | Kristof | 219/10.55 F |
| 4,427,867 | 1/1984 | Dills | 219/10.55 F |
| 4,701,586 | 10/1987 | Hagberg | 219/10.55 R |
| 5,015,813 | 5/1991 | Yamada et al. | 219/10.55 F |

FOREIGN PATENT DOCUMENTS 3242638 7/1983 Fed. Rep. of Germany .

*Primary Examiner*—Philip H. Leung
*Attorney, Agent, or Firm*—Young & Thompson

[57] ABSTRACT

Waveguide adapted to be mounted on the wall 1 of a cooking chamber between the antenna 2 of a magnetron 3 and an opening 5 provided in the wall 1, and comprising a metallic housing of generally tubular shape formed from a cover 7 comprising an upper elongated wall 8 of which a forward region extends above the wall 1 and of which a rear region extends above the magnetron 3, two side walls 9 and 10, two transverse forward 11 and rear 12 walls, and a base 13 comprising a bottom wall 14 traversed by a hole 16 for passage of the antenna 2 and opening opposite the opening 5. The cover 7 is formed from a single piece obtained by stamping and bending a metal sheet. The invention is applicable to microwave ovens for household use.

4 Claims, 1 Drawing Sheet

WAVEGUIDE FOR MICROWAVE OVENS

The invention relates to a waveguide adapted to be mounted on the wall of a cooking chamber of a microwave oven between the antenna of a magnetron of said oven and an opening provided in said wall.

It relates more particularly to a waveguide comprising a metallic housing of generally tubular shape with a substantially rectangular transverse cross section formed as a cover comprising an upper elongated wall of which a forward region extends above the wall and of which a rear region extends above the magnetron, two lateral longitudinal walls, two transverse forward and rear walls, and a base comprising a bottom wall traversed by a hole for passage of the antenna and opening toward the outlet opening for the waves.

The box of such a waveguide should be perfectly assembled so as to avoid any escape of waves, and the connection of the lateral and transverse walls with the upper wall forming the cover must have no imperfection. To accomplish this connection, there must be a precise bending of the pieces, and an assembly by welding. Then each cover is scrupulously inspected particularly as to the welds. It follows that these operations are long and difficult and result in an increase in cost for mass production.

The invention has for its object to overcome these drawbacks.

According to the invention, the cover is formed from a single piece obtained by a stamping and bending of a metal sheet.

Thanks to this stamping, there is obtained a one-piece cover without welding, having precise size which ensure an exact shape for its precise assembly with the base and the wall of the chamber, and thus preventing any loss of microwaves.

The characteristics and advantages of the invention will become further apparent from the description which follows, by way of example, with reference to the accompanying drawing, in which.

Figure 1:
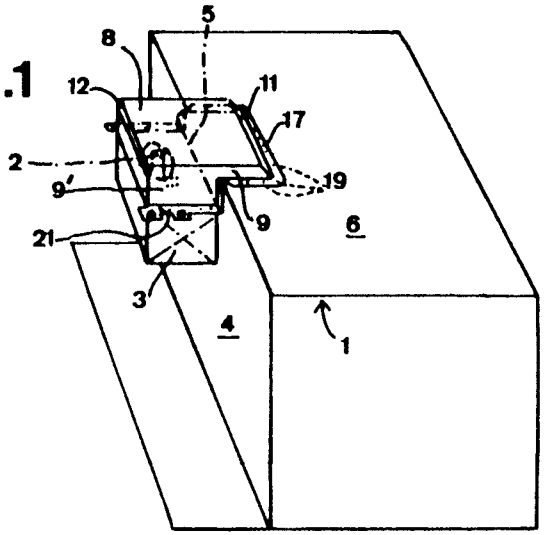
FIG. 1 is a schematic perspective view of a waveguide according to the invention mounted on a chamber of a microwave oven.

The illustrated waveguide is adapted to be mounted on the wall 1 of a cooking chamber of a microwave oven between the antenna 2 of a magnetron 3 installed laterally of one side surface 4 of the chamber, and an opening 5 (schematically shown in broken lines) provided in the wall 1 of the chamber. This opening 5 is provided along an edge of the chamber and therefore extends both on the lateral side 4 and on the upper side 6 of the wall 1.

Figure 2:
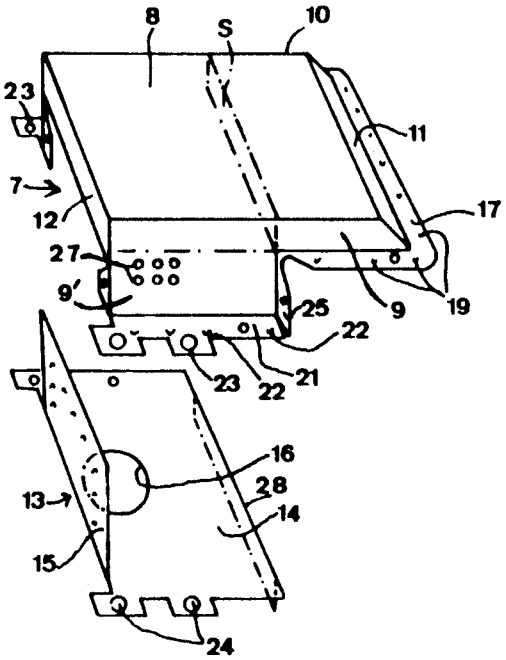
FIG. 2 shows in an exploded view and in perspective the waveguide of FIG. 1.

As is better seen in FIG. 2, the waveguide comprises a metal box of generally tubular shape with a transverse cross section S that is substantially rectangular. This box is formed from a cover 7 comprising an upper elongated wall 8 whose forward region extends above the upper surface 6 and whose rear region extends above the magnetron 3, two side and longitudinal walls 9 and 10, two transverse front and rear walls 11 and 12, and a base 13 comprising a bottom wall 14 extending below the rear portion of the wall 8 and a heel 15, said bottom wall 14 being traversed by a hole 16 for the passage of antenna 2 and opening toward the opening 5 provided in the wall 1 of the chamber to permit the output of waves.

According to the invention, the cover 7 is formed from a single piece obtained by stamping and bending of a metal sheet 16.

Thus there is obtained a one-piece cover without welding having a precise shape for its precision assembly with the base 13 and the wall of chamber 1 and thus preventing any escape of microwaves.

As shown particularly in FIG. 2, the transverse forward wall 11 and the portions of the lateral walls 9 and 10 adjacent the forward region of the upper wall 8 have respectively a bent edge 17 and a first portion 18 of the marginal peripheral plane of the stamping and comprise means 19 for securement with said wall of chamber 1.

The portions of the side walls 9 and 10 adjacent the rear region of the upper wall 8 comprise respectively in their planes prolongations 9' and 10' obtained by a first bending of a second portion 20 of the periphery of the stamping, each free edge of said elongations comprising a margin 21 which is obtained by a second bending and extends in a plane parallel to the bent edge 17, and which comprises securement means 22 with the bottom wall 14 and connection means 23 with the magnetron 3. The bottom wall 14 also comprises connection means 24. These connection means 23 and 24 are formed by sized holes through which pass screw threaded pins (not shown) carried by the magnetron 3.

The securement means 19 and 22 comprise a plurality of small bosses adapted to ensure welding of the margin 17 and the flanges 21 respectively with the walls of the chamber 1 and the bottom 14. The prolongations 9' and 10' have respectively on their lateral edges joining the flanges 21 and the margin 17 a securement tongue 25 adapted to be secured to the lateral face 4.

Figure 3:
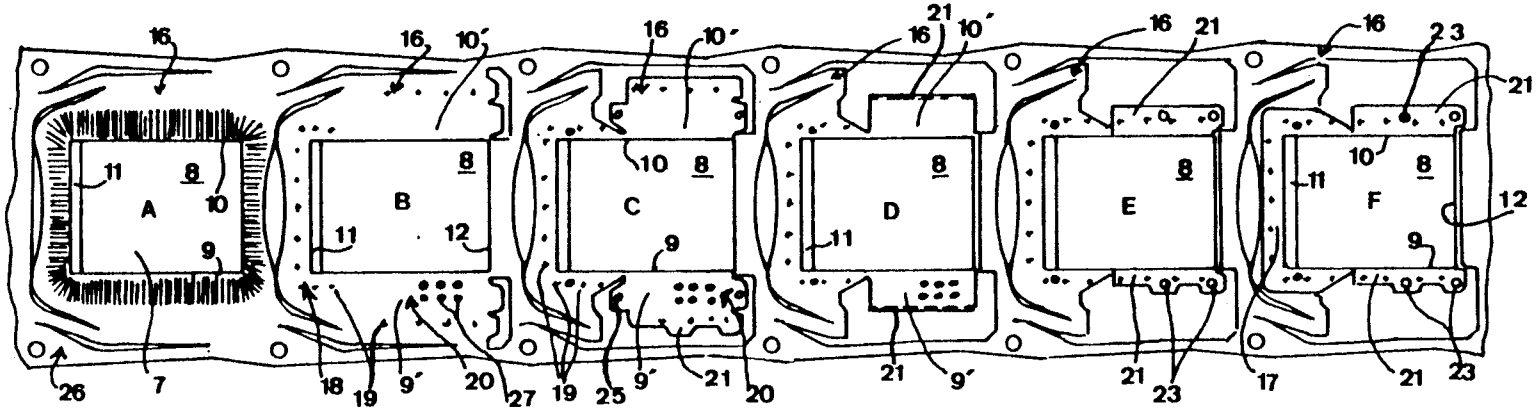
FIG. 3 is a plan view of a sheet illustrating the different machining operations for producing a cover for the waveguide.

There will now be described the process of making the cover 7 with reference to FIG. 3 which shows a strip 26 whose plate 16 called "sheet to be worked" is brought horizontally to different stations in which are effected the following successive operations:

A) stamping of the central region of the sheet 16 to form particularly the upper wall 8, the side walls 9 and 10 and transverse forward and rear walls 11, 12 of the cover 7;

B) machining flat the planar peripheral edge of the stamping particularly by extending outwardly the first and second sections 18 and 20 to obtain small bosses 19, and punching in one side of the second portion 20 a series of ventilating holes 27 for the waveguide;

C) bending of the portions 9' and 10';

D) second bending downwardly in planes perpendicular to the sheet 16 to form the flanges 21;

E) first bending, toward the stamped piece, to bring the prolongations 9' and 10' into the planes of the side walls 9 and 10, and precision punching to obtain the calibrated holes 23 in the flanges 21;

F) then final bending of the cover.

The cover being thus constituted, it is then assembled with the base 13. The bottom 14 is applied against the flange 21, and the heel 15 is applied against the internal surface of the transverse rear wall 12. The calibrated holes 23 and 24 are brought into coincidence and electric welding is conducted, facilitated by the small bosses 22, of the base on the cover 7. Once this operation is completed, there is obtained a waveguide housing in the form of a sealed housing whose opening, left between the forward transverse wall 11 and the edge 28 of the bottom wall 14, is adapted to come into registry with the opening 5 of the wall 1 of the chamber.

As will be understood, the waveguide thus constituted is welded on its upper surface 6 of the wall 1 of the chamber by means of the edge 17 and the small bosses 19 and secured on the side surface 4 by means of the tongue 25. Then, the magnetron 3 is mounted and adjusted on the waveguide by means of the calibrated holes 23 and 24 and the screw threaded rods passing through them.

What is claimed is:

1. In a waveguide adapted to be mounted on a wall (1) of a cooking chamber of a microwave oven between an antenna (2) of a magnetron (3) with which the oven is equipped and an opening (5) provided in the wall (1), and having a metallic housing of generally tubular shape of substantially rectangular cross-section formed from a cover (7) with an upper elongated wall (8) of which a forward region extends above the wall (1) and of which a rear region extends above the magnetron (3), two longitudinal side walls (9 and 10), two transverse forward (11) and rear (12) walls, and a base (13) having a bottom wall (14) traversed by a passage hole (16) for the antenna (2) and open opposite the opening (5) to permit exit of waves; the improvement:

wherein the cover (7) is formed of a single piece obtained by stamping and bending of a metal sheet;

wherein the transverse forward wall (11) and portions of the two longitudinal side walls (9 and 10) adjacent the forward region of the upper elongated wall (8) bear respectively a bent edge (17) bent to a first portion (18) of a flat peripheral edge of the stamped cover (7) and having first securement means (19) with the wall (1);

wherein the portions of the two longitudinal side walls (9 and 10) adjacent the rear region of the upper elongated wall (8) include, respectively, in their planes prolongations (9' and 10') obtained by deflection and first bending of a second portion (20) of the flat peripheral edge of the stamped cover (7), each free edge of said prolongations (9' and 10') comprising:

a flange (21) which is obtained by a second bending and extends in a plane parallel to the bent edge (17), and which includes second securement means (22) with the bottom wall (14) as well as connection means (23) with the magnetron (3).

2. Waveguide according to claim 1, wherein the first and second securement means (19 and 22) comprise:

a plurality of small bosses adapted to ensure welding of the bent edge (17) and the flange (21), respectively, with the wall (1) and the bottom wall (14).

3. A process for making a waveguide adapted to be mounted on a wall of a cooking chamber of a microwave oven between an antenna of a magnetron with which the oven is equipped and an opening provided in the wall, said waveguide comprising a metallic housing of general tubular shape of substantially rectangular cross-section formed from a base having a bottom wall traversed by a passage hole for the antenna and open opposite the opening, and a cover including an upper elongated wall of which a forward region extends above the wall of the cooking chamber and of which a rear region extends above the magnetron, two longitudinal side walls, and two transverse forward and rear walls, said transverse forward wall and portions of the two longitudinal side walls adjacent the forward region of the upper elongated wall of the cover bearing respectively a bent edge having a plurality of first small bosses ensuring the welding of the bent edge with the wall of the cooking chamber, and the portions of the two longitudinal side walls adjacent the rear region of the upper elongated wall of the cover including respectively in their plane prolongations, each free edge of which has a flange which extends in a plane parallel to the bent edge and which includes a plurality of second small bosses ensuring the welding of the flange with the bottom wall of the base and calibrated passage holes for connection means with the magnetron, said process comprising the following steps from a strip of metal having a portion brought successively to different stations:

stamping of a central region of the strip to form the upper elongated wall, the two longitudinal side walls and the transverse forward and rear walls of the cover;

working flat a peripheral border of the stamping by embossing first and second portions of the peripheral border to form respectively the first and the second small bosses;

piercing in a side of the second portion a series of ventilating holes;

deflecting portions intended to form the prolongations;

bending downwardly in planes perpendicular to the strip to form the flange;

bending towards the stamping to bring the prolongations into planes of the two longitudinal side walls;

piercing precisely the stamping to obtain the calibrated passage holes in the flange;

deflecting a portion intended to form the bent edge;

deflecting the cover; and assembling and welding the base with the cover.

4. A waveguide produced by the process of claim 3.

* * * * *